US005870982A

United States Patent [19]

Strawz

[11] Patent Number: 5,870,982

[45] Date of Patent: Feb. 16, 1999

[54] INTAKE VALVE OF A SUPERCHARGED TWO STROKE ENGINE

[76] Inventor: Frank T. Strawz, 8090 Candlewood Rd., Largo, Fla. 33777

[21] Appl. No.: 968,482

[22] Filed: Nov. 12, 1997

[51] Int. Cl.[6] ..... F02B 25/04

[52] U.S. Cl. ..... 123/65 VC; 123/65 V

[58] Field of Search ..... 123/65 V, 65 VA, 123/65 VC

[56] References Cited

U.S. PATENT DOCUMENTS

| | | | |
|---|---|---|---|
| 864,586 | 8/1907 | Wottring . | |
| 1,360,895 | 11/1920 | Craig . | |
| 2,523,599 | 9/1950 | Sparmann | 123/65 VA |
| 4,162,662 | 7/1979 | Melchior | 123/65 VD |
| 4,545,346 | 10/1985 | Grow | 123/305 |
| 4,840,147 | 6/1989 | Tanahashi et al. | 123/65 VD |
| 5,000,133 | 3/1991 | Kawamura | 123/65 VC |

*Primary Examiner*—Noah P. Kamen

[57] ABSTRACT

A two stroke supercharged internal combustion engine having a intake valve positioned in and part of the cylinder block wall and a exhaust valve in the cylinder head providing a regulated flow of gasses from bottom to top combustion chamber when scavenging and also isolating the piston rings lubricated with oil to minimize the contamination of the combustion chamber, exhaust gas and crankcase oil.

5 Claims, 6 Drawing Sheets

INTAKE VALVE OF A SUPERCHARGED TWO STROKE ENGINE

FIELD OF INVENTION

Figure 1:
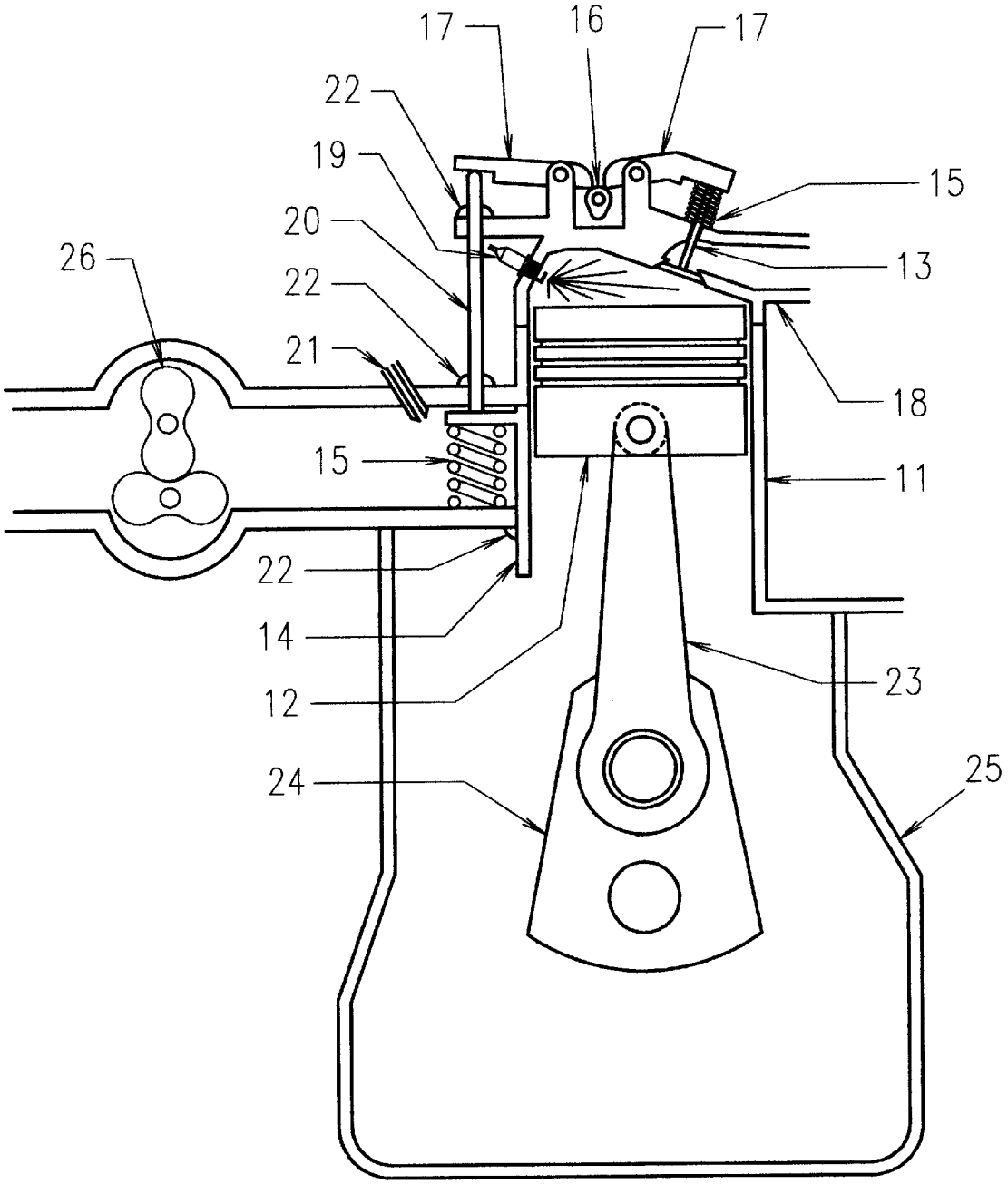

This invention relates to the combustion chamber of a two stroke internal combustion engine having at least two valves, a intake in the side and part of the cylinder wall, a exhaust valve in the cylinder head to provide a bottom to top flow of gasses when scavenging.

PRIOR ARTS

One method of scavenging, that is the expelling of spent gasses and resupply with air and fuel, is a system of scavenging "from below". Two ports or openings are located on opposite sides and near the bottom of the cylinder walls, one for intake, the other for exhaust. When the piston nears the bottom of the power stroke, the ports are exposed. First the exhaust port to start eliminating burnt gasses, then the intake to purge the chamber and resupply with air and fuel. The limitation to this mode of scavenging is the top of the cylinder is not fully purged due to the tendency of gasses to follow the path of least resistance and flow directly form port to port. Of greater concern is the use of ports for scavenging is when the piston and rings, lubricated with oil, pass the ports when reciprocating. This oil is blown off by the flow of gasses during scavenging thus contaminating intake and exhaust gasses resulting in high levels of pollution. This oil contamination adds to carbon deposits to build up in the exhaust port and causes an excessive consumption and contamination of lubricating oil. A modification of port scavenging locates an exhaust valve in the cylinder head while retaining the intake port in the cylinder wall. This resolves purging the top of the chamber, however, it does not solve the most serious limitation, the contamination of gasses with oil and consumption and contamination of lubricating oil when piston passes the open intake port.

Another means of scavenging provides a deflector or "masking wall" between the intake and exhaust valves located in he cylinder head. This deflector diverts the flow of gasses down along side of the cylinder wall, across the piston top, then back up to the exhaust valves, providing a looping flow of gasses for scavenging. To obtain a maximum flow of gasses, two sets of intake and exhaust valves are utilized. This is necessitated due to the short time duration available for scavenging in two cycle engine application. Having this deflector to prevent gasses from flowing directly from intake to exhaust valves and to provide a loop action in scavenging in order to purge the bottom of the cylinder hinders the free flow of gasses. Also by extending a deflector into the combustion chamber increases it's volume in order to clear the piston at top dead center, affecting the compression ratio.

A variation of loop action in scavenging uses a extended intake and exhaust tube to induce a piping effect plus deflectors to obtain a looping flow in scavenging. This again does not reduce the distance gasses must flow to complete a loop in the combustion chamber when scavenging operation occurs.

OBJECT AND ADVANTAGES

Accordingly, several objects and advantages of my invention are:

(a) to provide a two stroke internal combustion engine with a bottom to top flow of gasses for optimal means of scavenging.

(b) to provide the flow of gasses in one direction, bottom to top, thus shortening the distance of gas flow in the chamber enhancing the scavenging operation.

(c) to provide a barrier between intake flow of gasses and lubricating oil on piston and rings.

(d) to provide a reduction of contamination with oil in the combustion chamber.

(e) to provide a reduction of exhaust gas contamination with oil lowering exhaust and pollution.

By locating a intake valve into the cylinder wall and as part of the cylinder wall, the piston and rings covered with lubricating oil is isolated, a one direction from bottom to top flow of scavenging is provided. Whatever the precise merits, features and advantages of the cited references, none of them achieves or fulfills the purpose of scavenging a two stroke internal combustion engine as the present invention provides. Further objects and advantages of my invention will become apparent form a consideration of the drawings and the ensuing descriptions.

DRAWING FIGURES

FIG. 1. A overall schematic view showing the basic elements of a two stroke internal combustion engine as it relates to the start of the power stroke.

Figure 2:
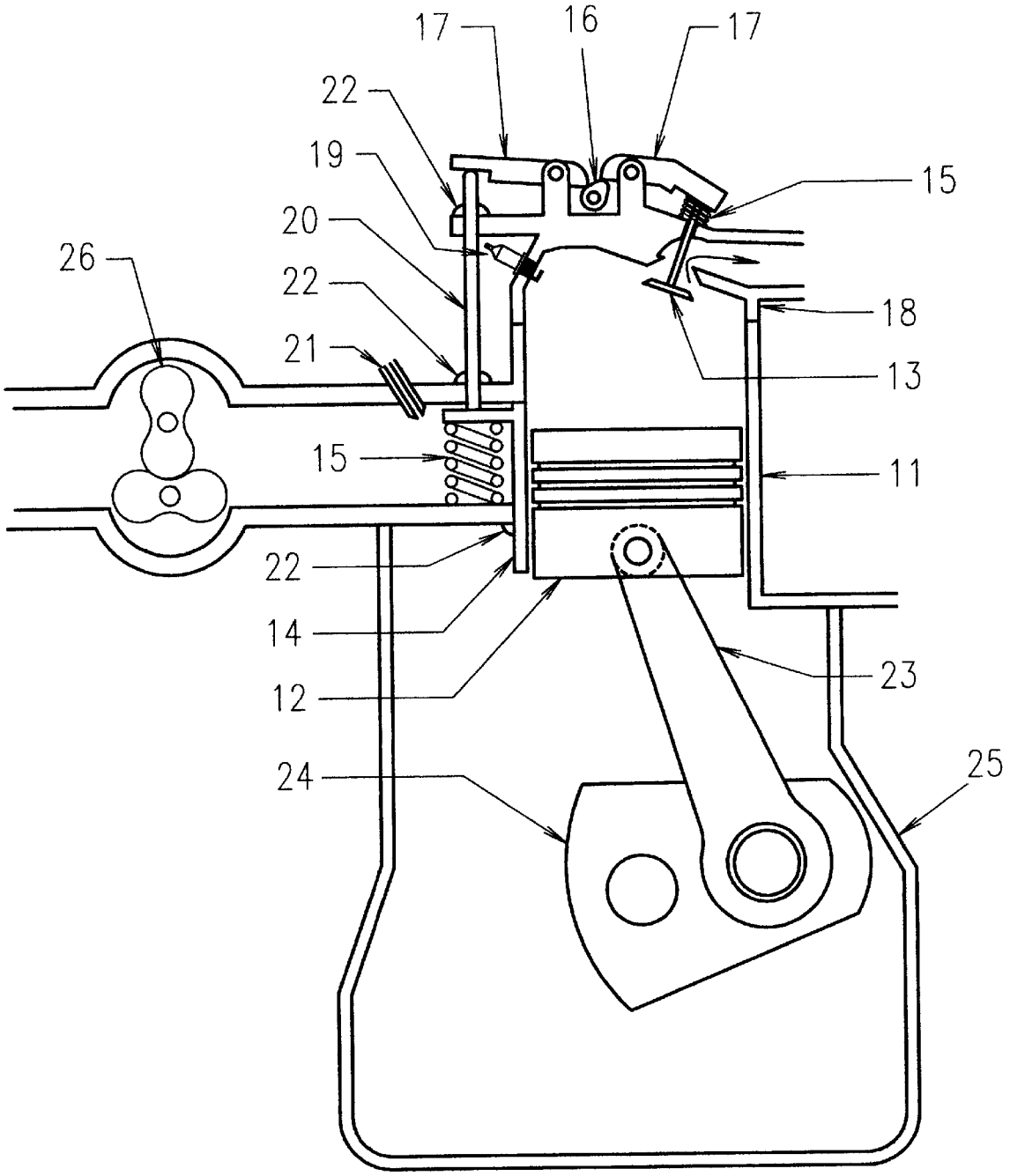
Figure 3:
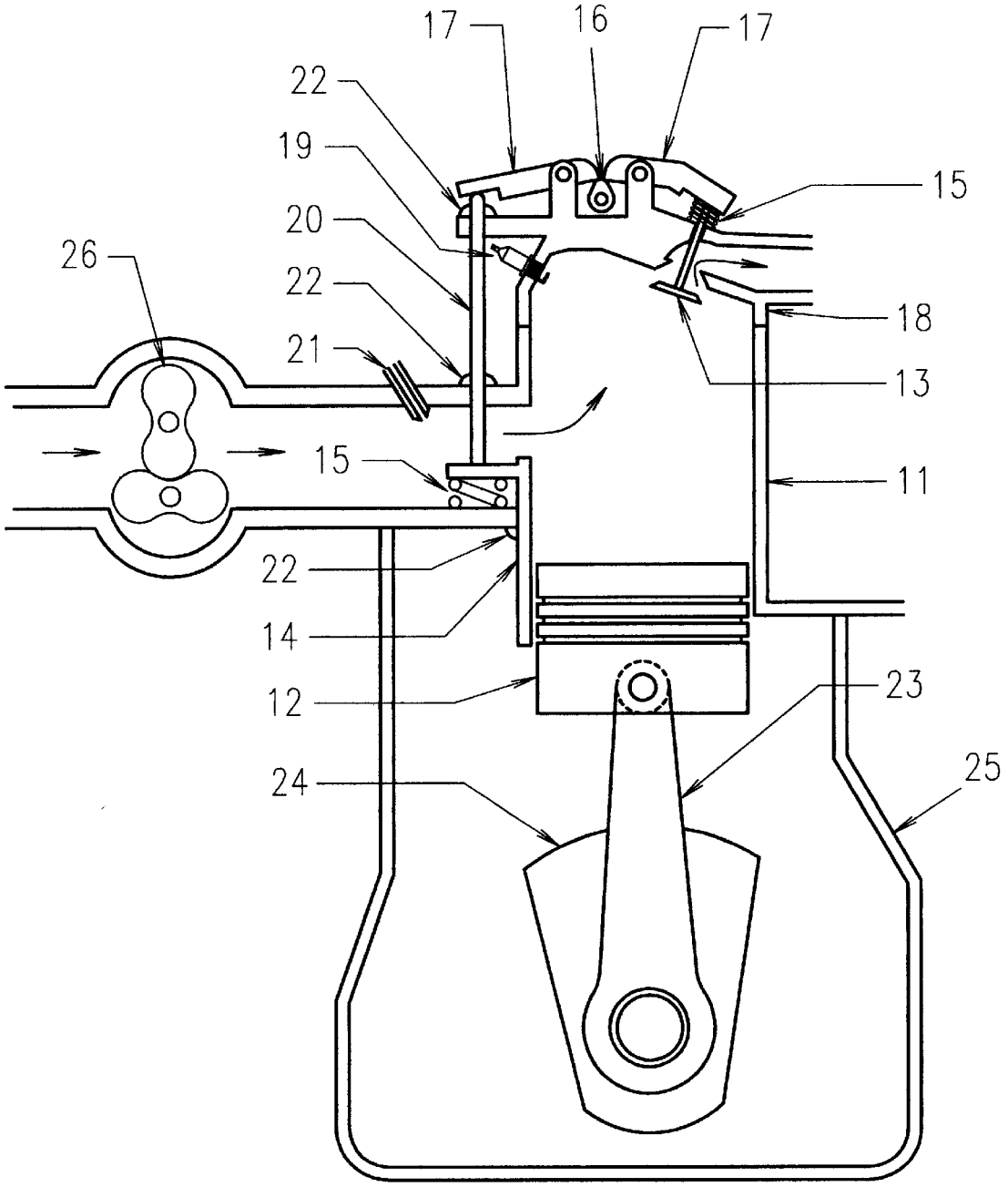

FIG. 2 A schematic view as it relates to the opening of the exhaust valve and the start of scavenging operation FIG. 3 A schematic view as it relates to the opening of the intake valve with the exhaust valve open to complete scavenging.

Figure 4:
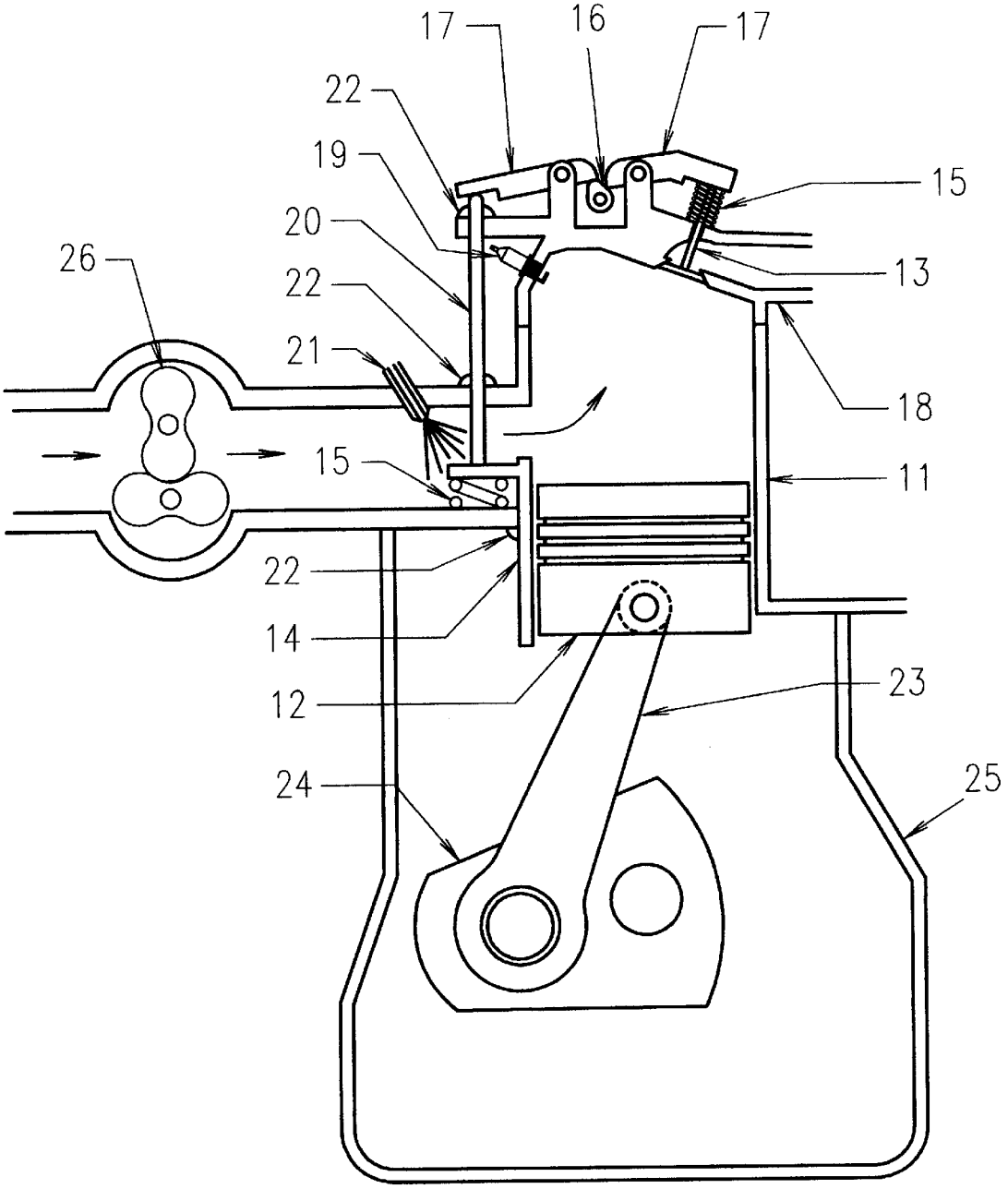

FIG. 4 A schematic view as it relates to gasoline engine application where gasoline fuel is injected into the intake passageway while intake valve is open and exhaust valve is closed.

Figure 5:
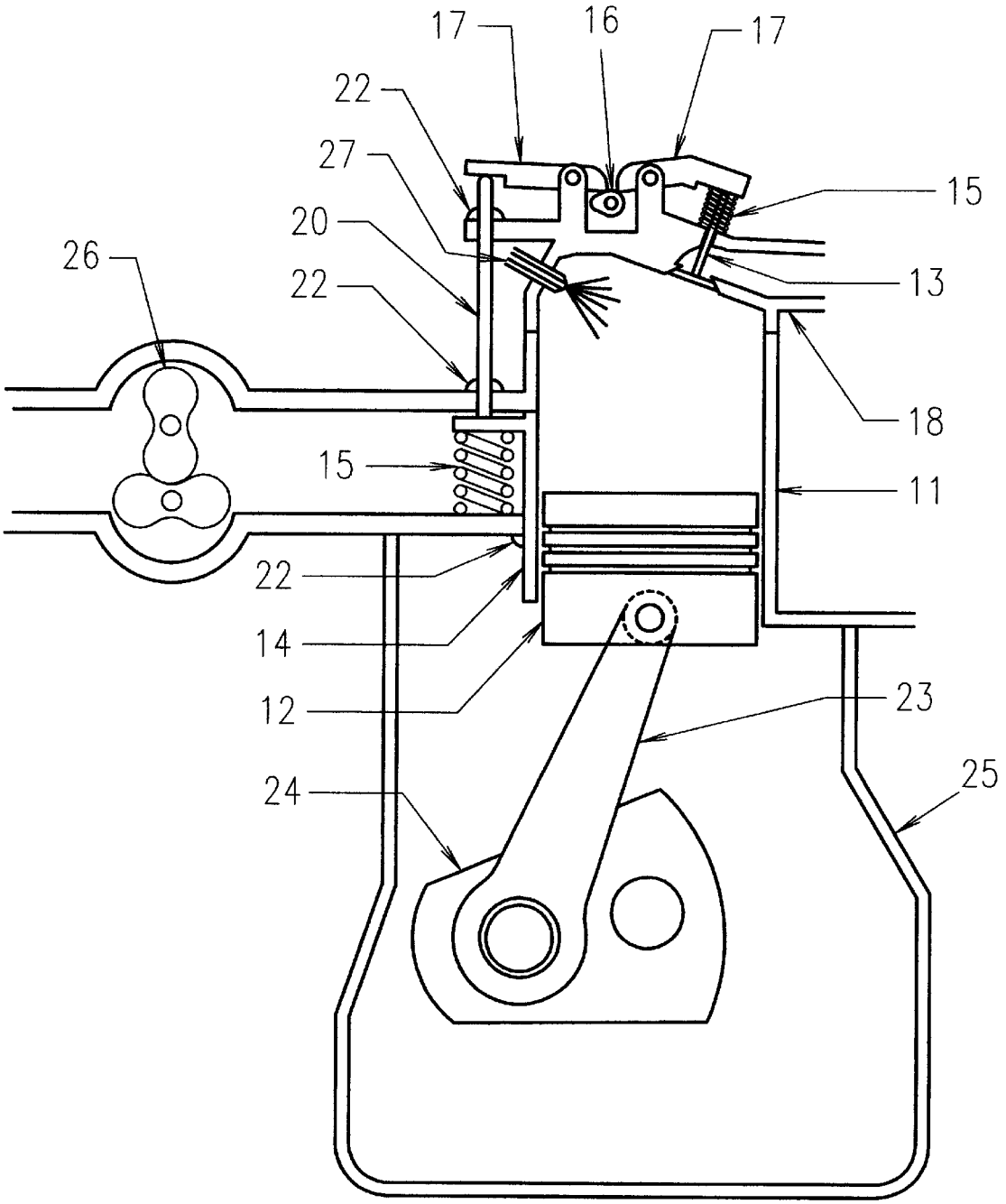

FIG. 5 A schematic view as it relates to Diesel engine application where diesel fuel is injected into combustion chamber on compression stroke with both intake and exhaust valves closed.

Figure 6:
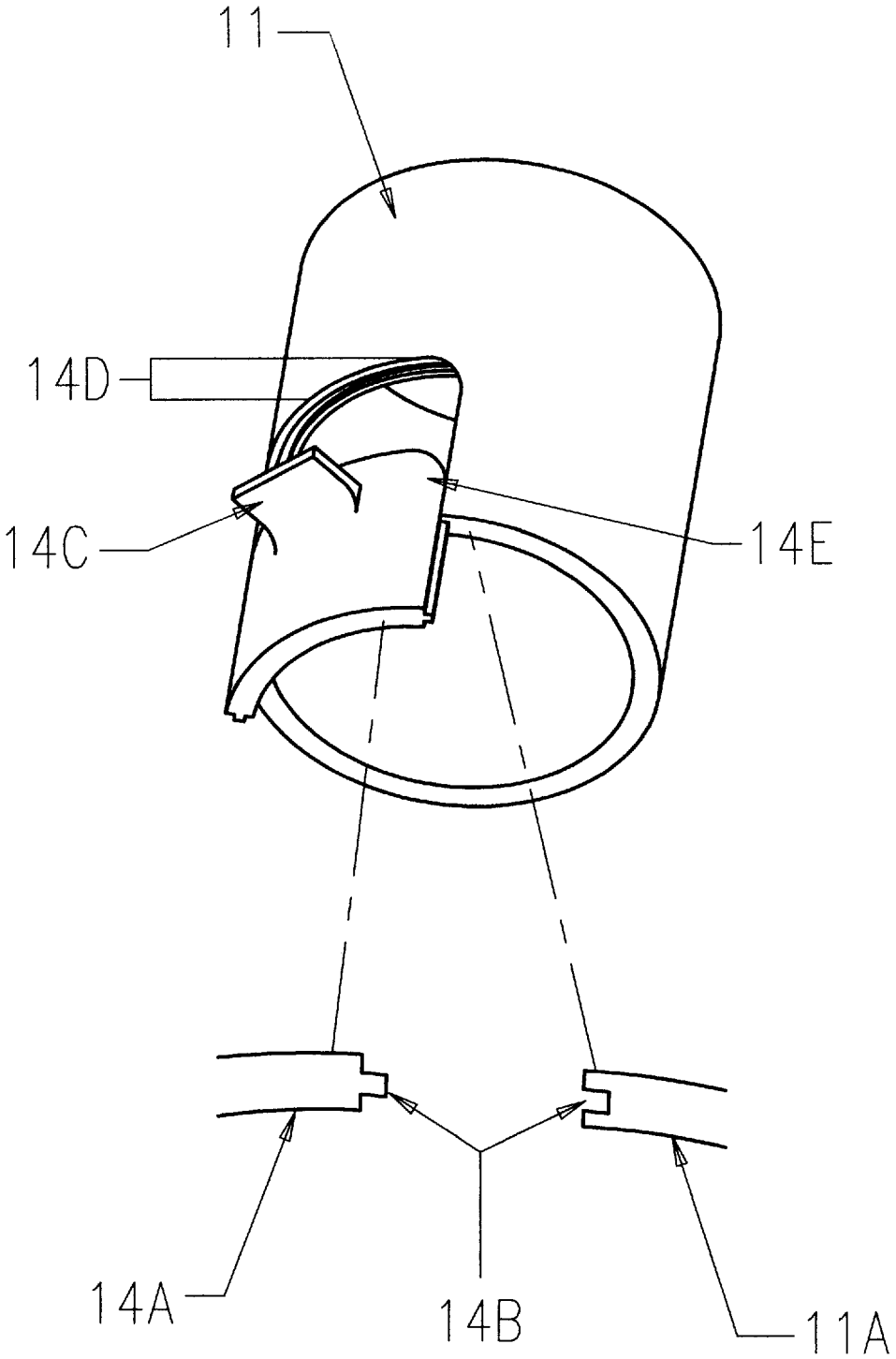

FIG. 6 A schematic view of part of the cylinder wall with the placement of a intake valve in the cylinder wall and part of the cylinder wall. The embodiment of the invention.

Reference Numerals in Drawings

| | | | |
|---|---|---|---|
| 11 | Cylinder Block | 11a | Grove in Cylinder Wall |
| 12 | Piston | 13 | Exhaust Valve |
| 14 | Intake Valve | 14a | Intake Valve End View |
| 14b | Intake Valve Tongue and Grove | 14c | Intake Valve Extension or Arm Push Rod and Valve Spring Seat |
| 14d | Intake Valve Slope or Taper | | |
| 14e | Intake Valve in open Mode | 15 | Valve Springs |
| 16 | Cam Shaft Lobe | 17 | Rocker Arms |
| 18 | Cylinder Head | 19 | Spark Plug |
| 20 | Push Rod | 21 | Gasoline Fuel Injector |
| 22 | Oil Seals | 23 | Connecting Rod |
| 24 | Crankshaft | 25 | Oil Pan |
| 26 | Supercharger Air Compressor | 27 | Diesel Fuel Injector |

DRAWING DESCRIPTION AND OPERATIONS (FIGS. 1 TO 6)

In drawings FIG. 1 to FIG. 5, reference number designating Cylinder Block 11, Piston 12, reciprocating within the cylinder Block 11, the Cylinder Head 18, defining a Combustion Chamber with oil Seals 22, Connecting Rod 23, Crankshaft 24, Oil pan 25, as components of a Two Stroke Internal Combustion Engine. FIG. 1 views the piston 12, at top dead center beginning of power stroke with gasoline fuel ignited by spark plug 19, with intake valve 14, and exhaust valve 13, in closed position in gasoline engine application. FIG. 2 views the piston 12, near the bottom of power stroke when exhaust valve 13, actuated by can shaft lobe 16, cooperating in sequence of piston 12, opens the exhaust valve 13, via rocker arm 17, to relieve combustion pressure of power stroke on intake valve 14, and start scavenging process. FIG. 3 while exhaust valve 13, is open, intake valve 14, is now opened by cam lobe 16, rocker arm 17, and push rod 20, cooperating in sequence with piston 12, to provide a bottom to top flow of gasses in scavenging operation for the combustion chamber while at the same time form a barrier to prevent lubricating oil in the piston 12, from contaminating the combustion chamber with oil on piston 12, being blown off when chamber is being charged with compressed air form supercharger 26, in continuing scavenging operation. The top edge of the intake valve substantially even with a top surface of the piston when located at bottom dead center. FIG. 4 with piston 12, starting the compression stroke, gasoline fuel is injected into the intake passage way by gasoline injector 21, while intake valve 14, is open and exhaust valve 13, is closed charging the chamber with fuel in gasoline engine application. FIG. 5 shows a diesel fuel injector 27, injecting fuel into the combustion chamber while intake valve 14, and exhaust valve 13, are in closed position and piston 12, is in the compression stroke in diesel engine application. FIG. 6 the embodiment of the invention, viewing the cylinder block wall 11, and the cylinder wall intake valve 14, with preferred but not exclusive means of securing the intake valve 14, to the cylinder block wall 11, by an extension or tongue 14*a*, on the outer edge of the intake valve 14, and a slot or grove 11*a*, in the cylinder block wall 11, to provide a guide and retainer 14*b*, for intake valve 14, to cylinder block wall 11, while permitting the intake valve 14, to open and close freely and at the same time to provide a seal when intake valve 14, is in closed position between supercharger 26, providing compressed air and piston 12, reciprocating past intake valve 14. A taper 14*d*, is incorporated in both intake valve 14, and cylinder block wall 11, providing a method of reducing combustion pressure on intake valve 14, and to minimize the possibility of damage to piston rings on piston 12, by seam or line between intake valve 14, and cylinder block wall 11, when piston 14, reciprocates by closed intake valve 14. Intake valve arm or extension 14*c*, provides a base or seat for push rod 20, to open valve 14, and valve spring 15, to close valve 14.

The forgoing description of preferred embodiments of the invention has been presented for the purpose of illustration and description. Accordingly the present invention becomes apparent by placing a intake valve into and part of the cylinder wall. It provides a bottom to top flow of gasses in scavenging, the shortest distance gasses must travel in time allotted in two cycle engine application. At the same time, with the valve as part of the cylinder wall when open, provides a barrier between intake gasses and lubricating oil on piston and rings. Also, when the intake valve is closed a seal is erected between compressed intake gasses and the crankcase lubricating oil. Both actions of the intake valve positioned in the cylinder wall minimizes the contamination of the combustion chamber, exhaust gasses and crankcase oil. Many modifications and variations are possible by those skilled in the art and listed in the descriptions.

It is intended that the scope of the invention, and patent, extended to any modification and be limited not by the detailed description by by claims attached hereto.

I claim:

1. A supercharged two stroke internal combustion engine having at least one cylinder block, a cylinder head cooperating with as least one piston reciprocating in the cylinder block to define as least one expandable combustion chamber, at least one intake valve positioned in the lower portion of the cylinder wall and part of the cylinder wall, defining at least one expandable combustion chamber and a means for opening the intake valve in proper time sequence in reciprocation of the piston thus regulating the flow of intake gasses when scavenging of combustion chamber occurs, at least one exhaust valve positioned in the cylinder head to regulate the flow of exhaust gasses from the combustion chamber and a means of operating the exhaust valve in proper time sequence with the piston thus providing a bottom to top flow of gasses when scavenging of combustion chamber occurs.

2. A supercharged two stroke engine according to claim 1, wherein a top edge of said intake valve has a taper, and said cylinder wall has an edge conforming to said taper and providing a seam minimizing damage of piston rings when the intake is closed.

3. A supercharged two stroke engine according to claim 1, wherein the operating means positions a top edge of said intake valve substantially even with a top surface of said piston when located at bottom dead center.

4. A supercharged two stroke internal combustion engine having at least one cylinder block, a cylinder head cooperating with at least one piston reciprocating in the cylinder block to define at least one expandable combustion chamber and at least one intake valve positioned in the lower portion of the cylinder wall and part of the cylinder wall to provide a barrier or separation to isolate the piston and piston rings lubricated with crankcase oil to minimize the contamination of the combustion chamber and exhaust gasses with lubricating oil when scavenging of combustion chamber occurs.

5. A supercharged two stroke internal combustion engine having at least one cylinder block, a cylinder head cooperating with at least one piston reciprocating in the cylinder block to define at least one expandable combustion chamber and at least one intake valve positioned in the lower portion of the cylinder wall and part of the cylinder wall, to provide a barrier or seal between the piston and compressed intake gasses when intake valve is closed.

* * * * *